US012215397B2

(12) United States Patent
Li et al.

(10) Patent No.: US 12,215,397 B2
(45) Date of Patent: Feb. 4, 2025

(54) HIGH-YIELD-RATIO COLD-ROLLED DUAL-PHASE STEEL AND MANUFACTURING METHOD THEREFOR

(71) Applicant: BAOSHAN IRON & STEEL CO., LTD., Shanghai (CN)

(72) Inventors: Wei Li, Shanghai (CN); Xiaodong Zhu, Shanghai (CN); Peng Xue, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 791 days.

(21) Appl. No.: 17/295,942

(22) PCT Filed: Nov. 22, 2019

(86) PCT No.: PCT/CN2019/120247
§ 371 (c)(1),
(2) Date: May 21, 2021

(87) PCT Pub. No.: WO2020/103927
PCT Pub. Date: May 28, 2020

(65) Prior Publication Data

US 2022/0010394 A1 Jan. 13, 2022

(30) Foreign Application Priority Data

Nov. 23, 2018 (CN) ..... 201811404464.3

(51) Int. Cl.
*C21D 8/02* (2006.01)
*C21D 1/26* (2006.01)
(Continued)

(52) U.S. Cl.
CPC ..... *C21D 8/0263* (2013.01); *C21D 1/26* (2013.01); *C21D 6/005* (2013.01); *C21D 6/008* (2013.01);
(Continued)

(58) Field of Classification Search
CPC ..... C21D 8/0263; C21D 1/26; C21D 6/005; C21D 6/008; C21D 8/0205; C21D 8/0226;
(Continued)

(56) References Cited

U.S. PATENT DOCUMENTS

2013/0213529 A1* 8/2013 Kimura ..... C22C 38/42 148/507
2015/0017472 A1* 1/2015 Kimura et al. ..... C23C 2/02

FOREIGN PATENT DOCUMENTS

CN 101768695 A 7/2010
CN 102094149 A 6/2011
(Continued)

OTHER PUBLICATIONS

JP200716319A Translation (Year: 2007).*
(Continued)

*Primary Examiner* — Brian D Walck
*Assistant Examiner* — Danielle Carda
(74) *Attorney, Agent, or Firm* — Lei Fang, Esq.; Smith Tempel Blaha LLC

(57) ABSTRACT

Disclosed is a high-yield-ratio cold-rolled dual-phase steel, having the following chemical elements in percentage by mass: 0.05%-0.08% of C, 0.9%-1.2% of Mn, 0.1%-0.6% of Si, 0.030%-0.060% of Nb, 0.030%-0.060% of Ti, 0.015%-0.045% of Al, and the balance being Fe and other inevitable impurities. A manufacturing method for the high-yield-ratio cold-rolled dual-phase steel, comprising: (1) smelting and casting; (2) hot rolling, wherein a casting blank is controlled and soaked at a temperature of 1200° C.-1250° C.; rolled with the finish rolling temperature being 840° C.-930° C.; cooled at a speed of 20° C./s-70° C./s, and then wound at the winding temperature being 570° C.-630° C.; (3) cold rolling; (4) annealing at the soaking temperature being 750° C.-790°
(Continued)

C. for 40 s-200 s, cooling at a speed of 30° C./s-80° C./s, the start temperature of cooling is 650° C. to 730° C., the aging temperature is 200° C. to 260° C., and the overaging time is 100 s to 400 s; and (5) leveling.

11 Claims, 1 Drawing Sheet

(51) Int. Cl.

| | |
|---|---|
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0205* (2013.01); *C21D 8/0226* (2013.01); *C21D 8/0236* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/004* (2013.01); *C21D 2211/005* (2013.01); *C21D 2211/008* (2013.01)

(58) Field of Classification Search
CPC ..... C21D 8/0236; C21D 2211/004; C21D 2211/005; C21D 2211/008; C21D 6/00; C21D 6/02; C21D 8/02; C21D 8/0247; C21D 9/46; C21D 1/19; C22C 38/00; C22C 38/001; C22C 38/02; C22C 38/04; C22C 38/06; C22C 38/12; C22C 38/14; C22C 1/19
USPC ..... 148/547
See application file for complete search history.

(56) References Cited

FOREIGN PATENT DOCUMENTS

| | | | | |
|---|---|---|---|---|
| CN | 103060703 | A | | 4/2013 |
| CN | 105039848 | A | | 11/2015 |
| CN | 105274432 | A | | 1/2016 |
| CN | 105925905 | A | | 9/2016 |
| CN | 107699791 | A | | 2/2018 |
| DE | 102016121905 | A1 | | 5/2018 |
| JP | 2007016319 | A | * | 1/2007 |
| JP | 2012112039 | A | | 6/2012 |

OTHER PUBLICATIONS

International Search Report mailed on Jan. 23, 2020 for PCT Patent Application No. PCT/CN2019/120247.
Written Opinion mailed on Jan. 23, 2020 for PCT Patent Application No. PCT/CN2019/120247.
Zhu, Xiaodong; et al. "Effect of Annealing Parameters on the Transformation and Mechanical Properties of a Low Carbon Dual Phase Steel" Baosteel Technology, No. 1, Dec. 31, 2014, ISSN: 1008-0716, pp. 1-4 and 17.

* cited by examiner

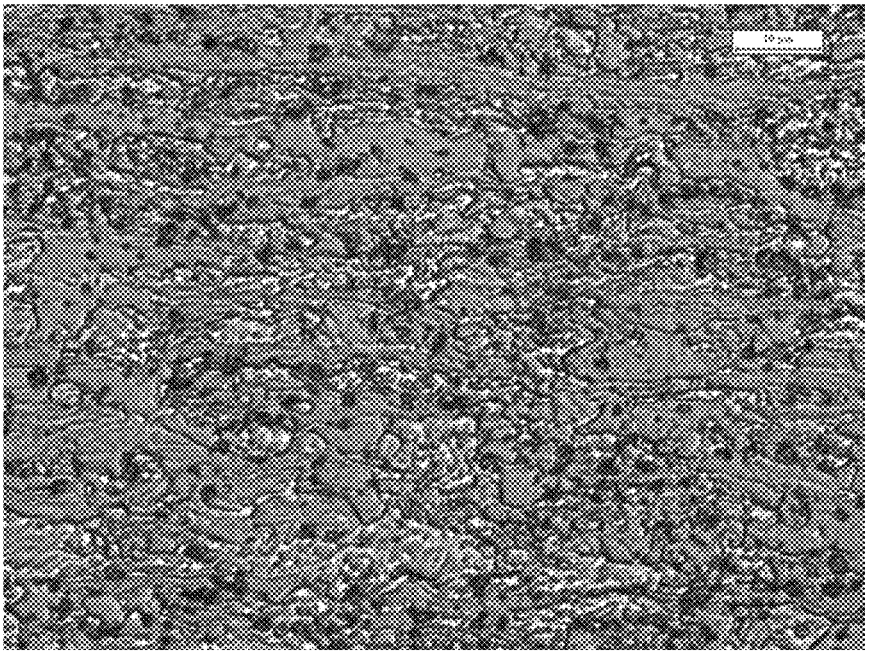

HIGH-YIELD-RATIO COLD-ROLLED DUAL-PHASE STEEL AND MANUFACTURING METHOD THEREFOR

CROSS-REFERENCE TO RELATED APPLICATIONS

This application is a 371 U.S. National Phase of PCT International Application No. PCT/CN2019/120247 filed on Nov. 22, 2019, which claims benefit and priority to Chinese patent application no. CN 201811404464.3 filed on Nov. 23, 2018, the contents of both are incorporated by reference herein in their entireties.

TECHNICAL FIELD

The present disclosure relates to a steel and a method for manufacturing the same, in particular to a dual-phase steel and a method for manufacturing the same.

BACKGROUND ART

As weight reduction and safety are required in the automotive industry, the market has an increasing demand for higher-strength steel plates. Dual-phase steel has excellent properties such as low yield strength, high tensile strength and high initial work hardening rate, and is widely used in the production of automotive parts. In view of the rebound of some automotive parts such as car seats in practical use, there is a high demand for 70 kg grade dual-phase steel having a high yield ratio (a yield ratio of greater than 0.8) in the market.

In the prior art, a Chinese patent application document bearing a publication number of 105063510A, a publication date of Nov. 18, 2015, and a title of "High-plasticity 700 MPa grade cold-rolled weather-resistant dual-phase steel and preparation method thereof" discloses a weather-resistant dual-phase steel having a chemical composition in mass percentages of 0.07-0.15% C, 0.30-0.80% Si, 1.40-1.70% Mn, <0.01% P, <0.01% S, 0.40-0.60% Cr, 0.20-0.30% Cu, 0.15-0.30% Ni, 0.02-0.05% Nb, 0.02-0.05% Ti, and a balance of Fe and other unavoidable impurities. The method for manufacturing the steel plate comprises heat preservation at 1200° C., finish rolling at 950-1050° C., annealing at 780-820° C., rapid cooling from 660-720° C. at a rapid cooling rate of 40° C./s, and termination of rapid cooling at a temperature of 320° C., wherein a 729-747 MPa steel plate having a yield strength of 328-346 MPa and an elongation of 21-22% is obtained. In the design of the composition of the steel plate, relatively large amounts of alloying elements such as Cr, Cu, Ni are used, and the content of Si is relatively high.

Another Chinese patent application document bearing a publication number of 102766812A, a publication date of Nov. 7, 2012, and a title of "700 MPa grade low yield ratio hot-rolled dual-phase steel plate and manufacturing method thereof" discloses a 700 MPa grade low yield ratio hot-rolled dual-phase steel plate having a chemical composition in mass percentages of 0.06%-0.09% C, 1.0%-1.2% Si, 1.10%-1.30% Mn, 0.020%-0.050% Al, 0.4%-0.6% Cr, and a balance of Fe. The cast slab used for manufacturing the steel plate is heated in a heating furnace and rolled through a hot continuous rolling unit. After rolling, a laminar cooling process is used for staged cooling, and an ultra-high strength hot-rolled dual-phase steel having a tensile strength of 700 MPa is obtained at the end.

In summary, the dual-phase steel products in the prior art are mainly classified into two types: (1) cold-rolled, annealed dual-phase steel plates containing relatively large amounts of such elements as Cu, Ni, Cr, etc.; and (2) low-yield ratio hot-rolled steel plates. These two types of products contain relatively large amounts of alloying elements, while the yield ratio is rather low.

In view of this situation, it is desirable to provide a dual-phase steel that contains less alloying elements and has a higher yield ratio to meet the market demand for dual-phase steel having a high yield ratio.

SUMMARY OF THE INVENTION

One of the objects of the present disclosure is to provide a cold-rolled dual-phase steel having a high yield ratio, wherein the dual-phase steel has a low cost, contains less alloying elements, and has a higher strength and a higher yield ratio, so that it can satisfy the market demand for dual-phase steel having a high yield ratio.

In order to attain the above object, the present disclosure provides a cold-rolled dual-phase steel having a high yield ratio, comprising the following chemical elements in mass percentages:

C: 0.05-0.08%, Mn: 0.9-1.2%, Si: 0.1-0.6%, Nb: 0.030-0.060%, Ti: 0.030-0.060%, Al: 0.015-0.045%, and a balance of Fe and other unavoidable impurities.

In the technical solution of the present disclosure, the various chemical elements are designed according to the following principles:

C: In the high-yield-ratio cold-rolled dual-phase steel of the present disclosure, carbon is a solid solution strengthening element which can guarantee the high strength of the material, increase the strength of martensite, and influence the content of martensite. If the mass percentage of carbon is too high or too low, it is disadvantageous to the properties of the steel. Therefore, the present disclosure limits the mass percentage of the carbon element in the high-yield-ratio cold-rolled dual-phase steel to 0.05-0.08%.

Mn: Manganese is an element that can strongly improve the hardenability of austenite and effectively increase the strength of steel, but it is not good for welding. If the mass percentage of Mn is lower than 0.9%, the strength of the steel will be insufficient; and if the mass percentage of Mn is higher than 1.2%, the strength of the steel will be too high. Therefore, the present disclosure limits the mass percentage of Mn in the high-yield-ratio cold-rolled dual-phase steel to 0.9-1.2%.

Si: Silicon is a solid solution strengthening element. On the one hand, it can increase the strength of the material. On the other hand, it can accelerate segregation of carbon to austenite, purify ferrite, and function to improve the elongation of the steel. At the same time, Si has a great influence on the structure of the steel. Si tends to accumulate on the surface to form an oxide film (red rust) that is difficult to remove. If the mass percentage of Si is less than 0.1%, the strength of the steel will be insufficient; and if the mass percentage of Si is higher than 0.6%, the surface quality of the steel will be easily affected. Therefore, the present disclosure limits the mass percentage of Si in the high-yield-ratio cold-rolled dual-phase steel to 0.1-0.6%.

Nb: Niobium is an element for precipitation of carbonitrides. It can refine grains and precipitate carbonitrides and improve the strength of the material. Therefore, the present disclosure limits the mass percentage of Nb in the high-yield-ratio cold-rolled dual phase steel to 0.030-0.060%.

Ti: Titanium is an element for precipitation of carbonitrides. It is used for fixing nitrogen and refining grains. It is conducive to increasing the yield strength of the material. Therefore, the present disclosure limits the mass percentage of Ti in the high-yield-ratio cold-rolled dual-phase steel to 0.030-0.060%.

Al: Al serves to remove oxygen and refine grains in steel. Therefore, the present disclosure limits the mass percentage of Al in the high-yield-ratio cold-rolled dual-phase steel to 0.015-0.045%.

Further, in the cold-rolled dual-phase steel having a high yield ratio according to the present disclosure, the microstructure is a complex phase structure of martensite+ferrite+[NbxTiy(C,N)z] carbonitride.

Still further, in the cold-rolled dual-phase steel having a high yield ratio according to the present disclosure, the phase proportion of the martensite is 20-30%, and the martensite is in the shape of long strips-islands (it is island-shaped when observed under a low-magnification metallographic microscope; it is lath or long strip-shaped when observing the fine structure of the martensite).

In the cold-rolled dual-phase steel having a high yield ratio according to the present disclosure, the phase proportion of the martensite is 20-30%, and the martensite is in the shape of long strips-islands. The martensite has a function of phase transformation strengthening. If the phase proportion of the martensite is too high or too low, the strength of the steel will be unduly high or low. Therefore, the present disclosure limits the phase proportion of the martensite in the cold-rolled dual-phase steel having a high yield ratio to 20-30%.

Further, in the cold-rolled dual-phase steel having a high yield ratio according to the present disclosure, the [NbxTiy(C,N)z] carbonitride has an irregular spherical shape and is uniformly distributed in the ferrite grains. The phase proportion of the [NbxTiy(C,N)z] carbonitride is 5-10%, wherein x+y=z.

In the cold-rolled dual-phase steel having a high yield ratio according to the present disclosure, the [NbxTiy(C,N)z] carbonitride has an irregular spherical shape and is uniformly distributed in the ferrite grains to achieve dispersion precipitation strengthening and increase the yield ratio.

If the phase proportion of the [NbxTiy(C,N)z] carbonitride is less than 5%, it cannot achieve the effect of increasing the yield ratio. After the phase proportion of the [NbxTiy(C,N)z] carbonitride is increased to be higher than 10%, the yield ratio of the steel will not change much. Therefore, the present disclosure limits the phase proportion of the [NbxTiy(C,N)z] carbonitride in the cold-rolled dual-phase steel having a high yield ratio to 5-10%.

Further, in the cold-rolled dual-phase steel having a high yield ratio according to the present disclosure, the [NbxTiy(C,N)z] carbonitride has a size of less than 2 μm.

Further, in the cold-rolled dual-phase steel having a high yield ratio according to the present disclosure, among the unavoidable impurities, the mass percentages of the P, S and N elements meet at least one of the following: P≤0.015%; S≤0.005%; N≤0.005%.

In the cold-rolled dual-phase steel having a high yield ratio according to the present disclosure, among the unavoidable impurities, the mass percentages of the P, S and N elements meet at least one of the following: P≤0.015%; S≤0.005%; N≤0.005%, according to the following principles:

P: P is an impurity element in steel. The lower the mass percentage of P, the better. With the requirements of both the production cost and process conditions taken into account, the present disclosure limits the mass percentage of P in the cold-rolled dual-phase steel having a high yield ratio to P≤0.015%.

S: S is an impurity element in steel. The lower the mass percentage of S, the better. With the requirements of both the production cost and process conditions taken into account, the present disclosure limits the mass percentage of S in the cold-rolled dual-phase steel having a high yield ratio to S≤0.005%.

N: N is an impurity element in steel. If its amount is too high, the surface of a slab tends to crack. Therefore, the lower the mass percentage of N, the better. With the requirements of both the production cost and process conditions taken into account, the present disclosure limits the mass percentage of N in the cold-rolled dual-phase steel having a high yield ratio to N≤0.005%.

Further, the cold-rolled dual-phase steel having a high yield ratio according to the present disclosure has a yield ratio of greater than 0.8.

Further, the cold-rolled dual-phase steel having a high yield ratio according to the present disclosure has a yield strength of 550-660 MPa, a tensile strength of ≥660 MPa, and an elongation at break of ≥15%.

Accordingly, another object of the present disclosure is to provide a method for manufacturing the above-mentioned cold-rolled dual-phase steel having a high yield ratio. The cold-rolled dual-phase steel having a high-yield ratio obtained by this method has a higher strength and a higher yield ratio.

To attain the above object, the present disclosure proposes a method for manufacturing a cold-rolled dual-phase steel having a high yield ratio, comprising the following steps:

(1) Smelting and casting;

(2) Hot rolling: controlling a cast blank for soaking at a temperature of 1200-1250° C.; rolling with a finish rolling temperature being controlled at 840-930° C.; cooling at a rate of 20-70° C./s after the rolling; then coiling with a coiling temperature being controlled at 570-630° C.;

(3) Cold rolling;

(4) Annealing: annealing at an annealing soaking temperature of 750-790° C. for an annealing time of 40-200 s; and then cooling at a rate of 30-80° C./s, wherein the cooling begins at a temperature of 650-730° C., an aging temperature is 200-260° C., and an over-aging time is 100-400 s;

(5) Temper rolling.

In the manufacturing method of the present disclosure, in Step (2), in order to ensure the stability of the rolling load, the temperature for heating the cast blank is controlled to be 1200° C. or higher. On the other hand, with the solid solubilities of Ti(C, N) and Nb(C, N)) in austenite taken into consideration, in order to ensure that the carbonitrides Ti(C,N) and Nb(C,N) can be precipitated at a high temperature, the upper limit of the temperature for heating the cast blank is controlled to be 1250° C. That is, the cast blank is controlled to be soaked at a temperature of 1200-1250° C., preferably for a soaking time of 5-6 hours, followed by rolling. In addition, in view of the formability after the annealing and the possibility that coarse grains will result in a nonuniform structure, the finish rolling temperature is controlled to be 840-930° C. After the rolling, cooling is performed at a rate of 20-70° C./s, preferably to 570-630° C., and then coiling is performed. The coiling temperature may be viewed as the precipitation temperature of the carbonitrides in ferrite, and the precipitation temperature is one of the main factors that control the size of the precipitates. The lower the precipitation temperature, the smaller the critical nucleus size for precipitation nucleation, and the finer the precipitates. In addition, the diffusion of Ti and Nb is slow. As a result, the growth rate of Ti and Nb is also small. From the perspective of kinetics, due to the high diffusion activation energies of Ti and Nb, the precipitation process of Ti(C,N) and Nb(C,N) is a result of long-range diffusion, and full precipitation needs sufficient time. If the cooling rate is too fast, the precipitation process of the second phase particles will be inhibited, and at the same time, the solid solution content will be increased. This is unfavorable for the precipitation process of Ti(C,N) and Nb(C,N), and the precipitation amount will be reduced. The coiling temperature is preferably 570-630° C.

In addition, in Step (4), the annealing soaking temperature and annealing time determine the degree of austenitization, and ultimately determine the phase proportions of martensite and ferrite in the steel structure. If the annealing soaking temperature is too high, the phase proportion of martensite will be so high that the strength of the final steel plate will be unduly high. If the annealing soaking temperature is too low, the phase proportion of martensite will be so low that the strength of the final steel plate will be unduly low. In addition, if the annealing soaking time is too short, the degree of austenitization will be insufficient; and if the annealing soaking time is too long, the austenite grains will become coarse. Therefore, in the manufacturing method according to the present disclosure, in Step (4), the annealing soaking temperature is controlled to be 750-790° C.; the annealing time is 40-200 s; and then cooling is performed at a rate of 30-80° C./s. The starting temperature of the cooling is 650-730° C.; the aging temperature is 200-260° C.; and the over-aging time is 100-400 s.

Further, in the manufacturing method according to the present disclosure, in Step (3), the cold rolling reduction rate is controlled to be 50-70%; and/or in Step (5), the temper rolling reduction rate is controlled to be 0.3-1.0%.

In the manufacturing method according to the present disclosure, in Step (3), in some embodiments, the mill scale on the steel surface may be removed by pickling, and then cold rolling is performed. In order to produce more polygonal ferrite in the steel structure, the cold rolling reduction rate is controlled to 50-70%. In addition, in Step (5), in order to ensure the flatness of the steel plate, the steel plate needs to be temper rolled to a certain degree. If it's temper rolled excessively, the yield strength will increase unduly. Therefore, in the manufacturing method according to the present disclosure, in Step (5), the temper rolling reduction rate is controlled to be 0.3-1.0%.

Compared with the prior art, the cold-rolled dual-phase steel having a high yield ratio and the manufacturing method thereof according to the present disclosure have the following beneficial effects:

(1) The cold-rolled dual-phase steel having a high yield ratio according to the present disclosure comprises less alloying elements (for example, it's free of Cr, Ni, Cu, and the Si content is also low), has a low cost, and is advantageous for improving the surface quality and phosphorization property of the cold-rolled dual-phase steel having a high yield ratio according to the present disclosure, such that it meets the requirements of automobile manufacturing.

(2) The cold-rolled dual-phase steel having a high-yield ratio according to the present disclosure has a higher strength and a higher yield ratio as well as a lower carbon equivalent, widely useful for structural parts and safety parts in the automobile industry.

(3) The cold-rolled dual-phase steel having a high yield ratio according to the present disclosure has a yield ratio of greater than 0.8, a yield strength of 550-660 MPa, a tensile strength of ≥660 MPa, and an elongation at break of ≥15%.

(4) The method for manufacturing the cold-rolled dual-phase steel having a high yield ratio according to the present disclosure also has the above-mentioned beneficial effects, which will not be repeated here.

BRIEF DESCRIPTION OF THE DRAWINGS

FIG. 1 is a microstructure diagram of a cold-rolled dual-phase steel having a high yield ratio in Example 2.

DETAILED DESCRIPTION OF THE INVENTION

The cold-rolled dual-phase steel having a high yield ratio according to the present disclosure and the method for manufacturing the same will be further explained and illustrated with reference to the accompanying drawing of the specification and the specific examples. Nonetheless, the explanation and illustration are not intended to unduly limit the technical solution of the present disclosure.

EXAMPLES 1-6 AND COMPARATIVE EXAMPLES 1-15

Table 1-1 and Table 1-2 list the mass percentages (wt %) of the chemical elements in the high-yield-ratio cold-rolled dual-phase steels of Examples 1-6 and Comparative Examples 1-15.

TABLE 1-1

(wt %, the balance is Fe and other unavoidable impurities except for P, S and N)

| No. | C | Si | Mn | P | S | Nb | Ti |
|---|---|---|---|---|---|---|---|
| Ex. 1 | 0.052 | 0.33 | 1.05 | 0.014 | 0.003 | 0.058 | 0.044 |
| Ex. 2 | 0.055 | 0.18 | 0.99 | 0.011 | 0.004 | 0.048 | 0.038 |
| Ex. 3 | 0.061 | 0.35 | 1.17 | 0.009 | 0.003 | 0.042 | 0.045 |
| Ex. 4 | 0.066 | 0.24 | 1.01 | 0.012 | 0.002 | 0.039 | 0.036 |
| Ex. 5 | 0.074 | 0.18 | 0.92 | 0.01 | 0.001 | 0.045 | 0.033 |
| Ex. 6 | 0.078 | 0.35 | 0.98 | 0.013 | 0.005 | 0.034 | 0.047 |
| Comp. Ex. 1 | 0.044 | 0.29 | 1.08 | 0.011 | 0.002 | 0.044 | 0.043 |
| Comp. Ex. 2 | 0.092 | 0.36 | 1.12 | 0.009 | 0.004 | 0.038 | 0.045 |
| Comp. Ex. 3 | 0.065 | 0.27 | 0.78 | 0.012 | 0.004 | 0.043 | 0.035 |
| Comp. Ex. 4 | 0.056 | 0.25 | 1.26 | 0.01 | 0.002 | 0.037 | 0.043 |
| Comp. Ex. 5 | 0.075 | 0.38 | 1.08 | 0.011 | 0.005 | 0.025 | 0.056 |
| Comp. Ex. 6 | 0.058 | 0.29 | 1.19 | 0.008 | 0.002 | 0.065 | 0.045 |
| Comp. Ex. 7 | 0.066 | 0.47 | 1.11 | 0.013 | 0.004 | 0.038 | 0.023 |
| Comp. Ex. 8 | 0.062 | 0.52 | 0.96 | 0.012 | 0.003 | 0.055 | 0.068 |
| Comp. Ex. 9 | 0.073 | 0.29 | 1.08 | 0.011 | 0.002 | 0.044 | 0.043 |
| Comp. Ex. 10 | 0.068 | 0.33 | 1.06 | 0.009 | 0.001 | 0.041 | 0.039 |
| Comp. Ex. 11 | 0.071 | 0.46 | 0.95 | 0.012 | 0.004 | 0.036 | 0.033 |
| Comp. Ex. 12 | 0.062 | 0.32 | 1.05 | 0.013 | 0.002 | 0.032 | 0.037 |
| Comp. Ex. 13 | 0.068 | 0.29 | 0.99 | 0.009 | 0.003 | 0.039 | 0.041 |
| Comp. Ex. 14 | 0.072 | 0.40 | 1.12 | 0.001 | 0.001 | 0.048 | 0.051 |
| Comp. Ex. 15 | 0.077 | 0.38 | 1.15 | 0.014 | 0.003 | 0.043 | 0.046 |

TABLE 1-2

(wt %, the balance is Fe and other unavoidable impurities except for P, S and N)

| No. | Al | N | C+(Mn + Si)/6 | phase proportion of ferrite (%) | phase proportion of martensite (%) | phase proportion of [NbxTiy(C,N)z] carbonitride (%) | average size of [NbxTiy(C,N)z] carbonitride (μm) |
|---|---|---|---|---|---|---|---|
| Ex. 1 | 0.021 | 0.0035 | 0.282 | 69.2 | 24.3 | 6.5 | 1.2 |
| Ex. 2 | 0.033 | 0.0044 | 0.250 | 69.9 | 22.7 | 7.4 | 0.8 |
| Ex. 3 | 0.028 | 0.0037 | 0.314 | 64.6 | 28.2 | 7.2 | 0.7 |
| Ex. 4 | 0.042 | 0.0028 | 0.274 | 69.6 | 21.6 | 8.8 | 1.0 |
| Ex. 5 | 0.038 | 0.0032 | 0.257 | 66.5 | 24.5 | 9.0 | 1.5 |
| Ex. 6 | 0.017 | 0.0047 | 0.300 | 68.2 | 26.2 | 5.6 | 0.6 |
| Comp. Ex. 1 | 0.034 | 0.0028 | 0.272 | 77.6 | 15.6 | 6.8 | 0.8 |
| Comp. Ex. 2 | 0.027 | 0.0044 | 0.339 | 54 | 38.5 | 7.5 | 1.1 |
| Comp. Ex. 3 | 0.032 | 0.0037 | 0.240 | 79.2 | 12.5 | 8.3 | 0.9 |
| Comp. Ex. 4 | 0.023 | 0.0028 | 0.308 | 51 | 41.2 | 7.8 | 1.6 |
| Comp. Ex. 5 | 0.035 | 0.0042 | 0.318 | 70 | 25.6 | 4.4 | 2.8 |
| Comp. Ex. 6 | 0.042 | 0.0036 | 0.305 | 67.9 | 18.9 | 13.2 | 0.4 |
| Comp. Ex. 7 | 0.028 | 0.0042 | 0.329 | 74.7 | 21.5 | 3.8 | 3.0 |
| Comp. Ex. 8 | 0.026 | 0.0036 | 0.309 | 62.8 | 22.9 | 14.3 | 0.5 |
| Comp. Ex. 9 | 0.034 | 0.0028 | 0.301 | 76.7 | 16.7 | 6.6 | 0.6 |
| Comp. Ex. 10 | 0.022 | 0.0029 | 0.300 | 55.5 | 37.4 | 7.1 | 3.1 |
| Comp. Ex. 11 | 0.043 | 0.0033 | 0.306 | 69.4 | 25.8 | 4.8 | 1.0 |
| Comp. Ex. 12 | 0.041 | 0.0044 | 0.290 | 70.6 | 24.9 | 4.5 | 1.2 |
| Comp. Ex. 13 | 0.038 | 0.0022 | 0.281 | 74.9 | 16.8 | 8.3 | 0.9 |
| Comp. Ex. 14 | 0.029 | 0.0035 | 0.325 | 55.6 | 36.8 | 7.6 | 1.5 |
| Comp. Ex. 15 | 0.030 | 0.0047 | 0.332 | 69.2 | 24.3 | 6.5 | 1.4 |

The method for manufacturing the high-yield-ratio cold-rolled dual-phase steels of Examples 1-6 and Comparative Examples 1-15 is as follows (the specific process parameters are listed in Table 2-1 and Table 2-2):

(1) Smelting and casting: Smelting and casting were carried out with the chemical elements listed in Table 1-1 and Table 1-2.

(2) Hot rolling: A cast blank was controlled for soaking at a temperature of 1200-1250° C. for 5-6 hours, and then rolled, wherein the finish rolling temperature was controlled at 840-930° C. After the rolling, the steel was cooled at a rate of 20-70° C./s to 570-630° C. Then, the steel was coiled, wherein the coiling temperature was controlled at 570-630° C.

(3) Cold rolling: The cold rolling reduction rate was controlled at 50-70%.

(4) Annealing: The annealing soaking temperature was 750-790° C.; and the annealing time was 40-200 s. Then, the steel was cooled at a rate of 30-80° C./s, wherein the cooling began at a temperature of 650-730° C. The aging temperature was 200-260° C., and the over-aging time was 100-400 s.

(5) Temper rolling: The temper rolling reduction rate was 0.3-1.0%.

TABLE 2-1

Specific process parameters for the method for manufacturing the high-yield-ratio cold-rolled dual-phase steels of Examples 1-6 and Comparative Examples 1-15

| | Step (2) | | | | Step (3) |
|---|---|---|---|---|---|
| No. | Soaking Temperature (° C.) | Finish Rolling Temperature (° C.) | Cooling Rate (° C./s) | Coiling Temperature (° C.) | Cold Rolling Reduction Rate (%) |
| Ex. 1 | 1240 | 925 | 40 | 585 | 62 |
| Ex. 2 | 1230 | 860 | 30 | 590 | 70 |
| Ex. 3 | 1250 | 900 | 60 | 615 | 65 |
| Ex. 4 | 1215 | 905 | 55 | 625 | 55 |
| Ex. 5 | 1220 | 855 | 50 | 580 | 58 |
| Ex. 6 | 1230 | 925 | 30 | 570 | 65 |
| Comp. Ex. 1 | 1230 | 890 | 60 | 595 | 50 |
| Comp. Ex. 2 | 1220 | 875 | 65 | 620 | 64 |
| Comp. Ex. 3 | 1200 | 915 | 70 | 580 | 68 |
| Comp. Ex. 4 | 1240 | 845 | 35 | 590 | 56 |
| Comp. Ex. 5 | 1250 | 880 | 30 | 570 | 55 |
| Comp. Ex. 6 | 1200 | 910 | 65 | 620 | 60 |
| Comp. Ex. 7 | 1245 | 860 | 30 | 595 | 62 |
| Comp. Ex. 8 | 1225 | 935 | 45 | 605 | 54 |
| Comp. Ex. 9 | 1190 | 905 | 40 | 590 | 62 |
| Comp. Ex. 10 | 1265 | 900 | 35 | 575 | 50 |
| Comp. Ex. 11 | 1245 | 855 | 60 | 550 | 55 |
| Comp. Ex. 12 | 1220 | 865 | 65 | 640 | 65 |
| Comp. Ex. 13 | 1225 | 895 | 55 | 600 | 68 |
| Comp. Ex. 14 | 1230 | 875 | 45 | 610 | 70 |
| Comp. Ex. 15 | 1240 | 925 | 65 | 585 | 52 |

TABLE 2-2

Specific process parameters for the method for manufacturing the high-yield-ratio cold-rolled dual-phase steels of Examples 1-6 and Comparative Examples 1-15

| | Step (4) | | | | | | Step (5) |
|---|---|---|---|---|---|---|---|
| No. | Annealing Soaking Temperature (° C.) | Annealing Time (s) | Cooling Rate (° C./s) | Initial Cooling Temperature (° C.) | Aging Temperature (° C.) | Over-aging Time (s) | Temper Rolling Reduction Rate (%) |
| Ex. 1 | 765 | 40 | 75 | 700 | 230 | 100 | 0.8 |
| Ex. 2 | 780 | 80 | 60 | 660 | 240 | 200 | 0.6 |
| Ex. 3 | 785 | 120 | 55 | 650 | 200 | 400 | 0.9 |
| Ex. 4 | 774 | 160 | 70 | 730 | 250 | 200 | 1.0 |
| Ex. 5 | 782 | 40 | 45 | 670 | 230 | 100 | 0.5 |
| Ex. 6 | 758 | 80 | 70 | 660 | 240 | 300 | 0.9 |
| Comp. Ex. 1 | 778 | 120 | 45 | 650 | 240 | 300 | 0.6 |
| Comp. Ex. 2 | 785 | 160 | 50 | 670 | 200 | 400 | 0.7 |
| Comp. Ex. 3 | 755 | 40 | 60 | 660 | 250 | 200 | 0.8 |
| Comp. Ex. 4 | 790 | 80 | 55 | 650 | 230 | 100 | 0.9 |
| Comp. Ex. 5 | 775 | 120 | 35 | 730 | 240 | 300 | 1.0 |
| Comp. Ex. 6 | 768 | 160 | 80 | 670 | 200 | 400 | 0.5 |
| Comp. Ex. 7 | 786 | 80 | 65 | 670 | 260 | 300 | 0.8 |
| Comp. Ex. 8 | 766 | 100 | 30 | 660 | 220 | 200 | 0.6 |
| Comp. Ex. 9 | 775 | 40 | 45 | 720 | 250 | 200 | 0.7 |
| Comp. Ex. 10 | 785 | 80 | 70 | 700 | 230 | 100 | 0.8 |
| Comp. Ex. 11 | 768 | 120 | 45 | 680 | 240 | 300 | 0.5 |
| Comp. Ex. 12 | 755 | 160 | 50 | 650 | 240 | 200 | 0.9 |
| Comp. Ex. 13 | 745 | 40 | 45 | 695 | 200 | 100 | 1.0 |
| Comp. Ex. 14 | 805 | 80 | 55 | 705 | 250 | 300 | 0.8 |
| Comp. Ex. 15 | 774 | 160 | 60 | 730 | 230 | 300 | 1.2 |

The high-yield-ratio cold-rolled dual-phase steels of Examples 1-6 and Comparative Examples 1-15 were tested for their properties. The test results are listed in Table 3.

TABLE 3

| No. | Yield Strength (MPa) | Tensile Strength (MPa) | Elongation At Break (%) | Yield Ratio |
|---|---|---|---|---|
| Ex. 1 | 580 | 690 | 19.5 | 0.84 |
| Ex. 2 | 575 | 686 | 18.4 | 0.84 |
| Ex. 3 | 604 | 720 | 18.2 | 0.84 |
| Ex. 4 | 652 | 764 | 15.6 | 0.85 |
| Ex. 5 | 643 | 751 | 15.3 | 0.86 |
| Ex. 6 | 628 | 708 | 17.5 | 0.89 |
| Comp. Ex. 1 | 525 | 650 | 21.2 | 0.81 |
| Comp. Ex. 2 | 693 | 790 | 14.3 | 0.88 |
| Comp. Ex. 3 | 508 | 632 | 22.6 | 0.80 |
| Comp. Ex. 4 | 685 | 814 | 13.8 | 0.84 |
| Comp. Ex. 5 | 564 | 754 | 16.1 | 0.75 |
| Comp. Ex. 6 | 632 | 724 | 17.6 | 0.87 |
| Comp. Ex. 7 | 555 | 708 | 18.8 | 0.78 |
| Comp. Ex. 8 | 602 | 697 | 19.3 | 0.86 |
| Comp. Ex. 9 | 532 | 646 | 21.8 | 0.82 |
| Comp. Ex. 10 | 683 | 796 | 14.1 | 0.86 |
| Comp. Ex. 11 | 564 | 734 | 17.9 | 0.77 |
| Comp. Ex. 12 | 568 | 727 | 17.6 | 0.78 |
| Comp. Ex. 13 | 565 | 638 | 21.7 | 0.89 |
| Comp. Ex. 14 | 684 | 785 | 14.6 | 0.87 |
| Comp. Ex. 15 | 699 | 774 | 15.2 | 0.90 |

As can be seen from Table 3, the high-yield-ratio cold-rolled dual-phase steels of Examples 1-6 and Comparative Examples 1-15 have a tensile strength of ≥660 MPa, an elongation at break of ≥15%, and a yield ratio of greater than 0.8. Thus, it can be seen that the cold-rolled dual-phase steel having a high yield ratio according to the present disclosure has the advantages of high strength, low carbon equivalent and high yield ratio.

FIG. 1 is a microstructure diagram of a cold-rolled dual-phase steel having a high yield ratio in Example 2.

As can be seen from FIG. 1, the microstructure of the high-yield-ratio cold-rolled dual-phase steel of Example 2 is a complex phase structure of martensite+ferrite+[NbxTiy(C,N)z] carbonitride, wherein the martensite has a phase proportion of 20-30%, and has a function of phase transformation strengthening. The martensite structure is in the shape of long strips-islands (it is island-shaped when observed under a low-magnification metallographic microscope; it is lath or long strip-shaped when observing the fine structure of the martensite). Meanwhile, the [NbxTiy(C,N)z] carbonitride has an irregular spherical shape and is uniformly distributed in the ferrite grains. The carbonitride has a size of less than 2 μm, and has a function of dispersion precipitation strengthening in the structure.

It's to be noted that the prior art portions in the protection scope of the present disclosure are not limited to the examples set forth in the present application file. All the prior art contents not contradictory to the technical solution of the present disclosure, including but not limited to prior patent literature, prior publications, prior public uses and the like, may all be incorporated into the protection scope of the present disclosure.

In addition, the ways in which the various technical features of the present disclosure are combined are not limited to the ways recited in the claims of the present disclosure or the ways described in the specific examples. All the technical features recited in the present disclosure may be combined or integrated freely in any manner, unless contradictions are resulted.

It should also be noted that the above-listed Examples are only specific embodiments of the present disclosure. Obviously, the present disclosure is not limited to the above Examples, and similar changes or modifications can be directly derived from or easily associated with the disclosure of the present disclosure by those skilled in the art, and should fall within the protection scope of the present disclosure.

We claim:

1. A cold-rolled dual-phase steel having a high yield ratio, comprising the following chemical elements in mass percentages:

C: 0.05-0.08%, Mn: 0.9-1.2%, Si: 0.1-0.6%, Nb: 0.030-0.060%, Ti: 0.030-0.060%, Al: 0.015-0.045%, and a balance of Fe and other unavoidable impurities, wherein the steel has a microstructure which is a complex phase structure of martensite+ferrite+[$Nb_xTi_y(C,N)_z$] carbonitride, wherein the martensite has a phase proportion of 20-30%, and the martensite is in the shape of long strip-islands, wherein the [$Nb_xTi_y(C,N)_z$] carbonitride has an irregular spherical shape and is uniformly distributed in ferrite grains, and the [$Nb_xTi_y(C,N)_z$] carbonitride has a phase proportion of 5-10%, and wherein the steel has a yield ratio of greater than 0.8.

2. The cold-rolled dual-phase steel having a high yield ratio according to claim 1, wherein the [$Nb_xTi_y(C,N)_z$] carbonitride has a size of less than 2 μm.

3. The cold-rolled dual-phase steel having a high yield ratio according to claim 1, wherein among the other unavoidable impurities, mass percentages of the P, S and N elements meet at least one of the following: P≤0.015%; S≤0.005%; N≤0.005%.

4. The cold-rolled dual-phase steel having a high yield ratio according to claim 1, wherein the steel has a yield strength of 550-660 MPa, a tensile strength of ≥660 MPa, and an elongation at break of ≥15%.

5. A manufacturing method for the cold-rolled dual-phase steel having a high yield ratio according to claim 1, wherein the method comprises the following steps:

(1) Smelting and casting;

(2) controlling a cast blank for soaking at a temperature of 1200-1250° C.; rolling with a finish rolling temperature being controlled at 840-930° C.; cooling at a rate of 20-70° C./s after the rolling; then coiling with a coiling temperature being controlled at 570-630° C.;

(3) Cold rolling;

(4) annealing at an annealing soaking temperature of 750-790° C. for an annealing time of 40-200 s; and then cooling at a rate of 30-80° C./s, wherein the cooling begins at a temperature of 650-730° C., an aging temperature is 200-260° C., and an over-aging time is 100-400 s; and (5) Temper rolling.

6. The manufacturing method according to claim 5, wherein in Step (3), a cold rolling reduction rate is controlled to be 50-70%; and/or in Step (5), a temper rolling reduction rate is controlled to be 0.3-1.0%.

7. The manufacturing method according to claim 5, wherein in Step (2), a soaking time is 5-6 hours; the steel is cooled to 570-630° C. after the rolling; and then the coiling is performed.

8. The manufacturing method according to claim 5, wherein the steel has a microstructure which is a complex phase structure of martensite+ferrite+[$Nb_xTi_y(C,N)_z$] carbonitride.

9. The manufacturing method according to claim 5, wherein the [$Nb_xTi_y(C,N)_z$] carbonitride has a size of less than 2 μm.

10. The manufacturing method according to claim 5, wherein among the other unavoidable impurities of the cold-rolled dual-phase steel, mass percentages of the P, S and N elements meet at least one of the following: P≤0.015%; S≤0.005%; N≤0.005%.

11. The manufacturing method according to claim 5, wherein the steel has a yield strength of 550-660 MPa, a tensile strength of ≥660 MPa, and an elongation at break of ≥15%.

* * * * *